US006722181B2

(12) United States Patent
Nagakura

(10) Patent No.: US 6,722,181 B2
(45) Date of Patent: Apr. 20, 2004

(54) BENDING METHOD AND BENDING APPARATUS

(75) Inventor: Seiju Nagakura, Aichi (JP)

(73) Assignee: Toyokoki Co., Ltd., Aichi (JP)

( * ) Notice: Subject to any disclaimer, the term of this patent is extended or adjusted under 35 U.S.C. 154(b) by 76 days.

(21) Appl. No.: 10/195,524

(22) Filed: Jul. 16, 2002

(65) Prior Publication Data

US 2003/0015012 A1 Jan. 23, 2003

(30) Foreign Application Priority Data

Jul. 17, 2001 (JP) ..... 2001-217181

(51) Int. Cl.[7] ..... B21D 11/22

(52) U.S. Cl. ..... 72/461; 72/18.2; 72/31.1; 72/31.11; 72/420; 72/389.3

(58) Field of Search ..... 72/15.3, 18.2, 72/18.5, 31.1, 31.11, 31.12, 389.3, 420, 422, 441, 461; 269/315, 320; 901/24; 83/269, 367

(56) References Cited

U.S. PATENT DOCUMENTS 4,430,879 A * 2/1984 Rolland ..... 72/389.3
4,831,862 A * 5/1989 Ohashi et al. ..... 72/389.3
5,497,647 A * 3/1996 Nagakura ..... 72/389.3
5,842,366 A * 12/1998 Klingel et al. ..... 72/31.1
5,865,056 A * 2/1999 Nagakura ..... 72/461
6,003,353 A * 12/1999 Ootani et al. ..... 72/31.1

* cited by examiner

*Primary Examiner*—Allen Ostrager
*Assistant Examiner*—John S Goetz
(74) *Attorney, Agent, or Firm*—Hunton & Williams LLP

(57) ABSTRACT

A method for bending a work of a plate shape by moving a die with the work being butted against a butting member, and an apparatus for executing the method are provided. The bending apparatus is provided with an input unit for inputting data on bending conditions including respective target values of a bending angle and a bending dimension, as well as respective measured values of a bending angle and a bending dimension of the work obtained in trial bending. A control device installed in the apparatus executes an initial computation for computing an operation amount of the die when the data on bending conditions are inputted. Further, the control device executes computation for a correction value for an operation amount of the die and computation for an estimated value of a bending dimension when the respective measured values of the bending angle and the bending dimension obtained in trial bending are inputted. This way, the control device controls a reciprocating mechanism to correct the position of the butting member according to the estimated value of a bending dimension, and to move the die according to the corrected operation amount.

17 Claims, 8 Drawing Sheets

BENDING METHOD AND BENDING APPARATUS

This application claims priority to Japanese Patent Application 2001-217181 filed on Jul. 17, 2001, the disclosure of which is incorporated herein by reference in its entirety.

BACKGROUND OF THE INVENTION

The invention relates to a bending method for bending a work of a plate shape by moving a die, with the work being butted against a butting member. The invention also relates to a bending apparatus, such as a press brake, for conducting such bending.

A typical press brake is, as shown in FIGS. 5 and 6, composed of a press machine main unit 1 and a back gauge mechanism 2 arranged behind the press machine main unit 1. In the press machine main unit 1, a ram 5 holding an upper die 3 and a table 6 holding a lower die 4 are positioned so as to vertically oppose to each other. The ram 5 is moved upward and downward by a reciprocating mechanism driven by a hydraulic cylinder or a servomotor. A work W is bent to a predetermined angle when the reciprocating mechanism is driven to lower the upper die 3 for pushing the work W by a predetermined amount into a V-shaped groove of the lower die 4.

The back gauge mechanism 2 has a pair of butting members 9 and 10 against which the rear end edge of the work W is butted. The members 9 and 10 are arranged side by side. Each of the butting members 9 and 10 are moveable forward and backward (indicated as an "A" direction in FIG. 6), side to side (indicated as an "E" direction in FIG. 6), and upward and downward (indicated as a "C" direction in FIG. 5). In FIG. 6 a slide guide 11 supports the butting members 9 and 10 such that the butting members are able to slide in the sideways directions E in a reciprocating manner. Both the end portions of the slide guide 11 are connected to drive mechanisms 12 and 13, such as ball screw mechanisms, respectively. Prior to bending work, the right and left drive mechanisms 12 and 13 are driven to define the positions of the butting members 9 and 10 in the forward and backward directions, or the A direction. The work W is sent to be positioned between the upper die 3 and the lower die 4 of the press machine main unit 1, and is butted against each of the butting members 9 and 10 at the rear end edge thereof. A predetermined bending dimension is obtained when the work W is bent while the work is being butted in this way.

FIGS. 7 and 8 show a state when the work W of a plate shape, i.e., having a plate shape, is bent. In FIG. 7, a distance B1 between a rear end edge 15 and a bending position 16 of the work W is generally referred to as an "absolute dimension of bending." Further, in FIG. 8, a distance L between the rear end edge 15 of the bent work W and an intersection point Po at which planes passing through the outer faces of the work W cross is referred to as an "outer bending dimension." Also, a distance B2 between the rear end edge 15 of the bent work W and an intersection point Pi at which planes passing through the inner faces of the work W cross is referred to as an "inner bending dimension." The outer dimension L and the inner dimension B2 with a bending angle of 90° are shown in FIG. 9.

The outer dimension L is generally larger than the absolute dimension B1, and the difference between the two is referred to as an "elongation amount." This "elongation amount" of an outer dimension is dependent on bending conditions including a bending angle and a thickness of the work W. A "bending dimension" generally means the outer dimension L. This is because drawings for sheet-metal working often carry the outer dimension L, and further, the outer dimension L is the most easily measurable dimension in the measurement of the work W with a measuring device such as a vernier caliper after completing bending. Accordingly, as used herein, the "bending dimension" means the outer dimension L.

Generally, prior to bending, the material and the thickness of the work W, conditions of bending such as dies, a target value of a bending dimension, and a target value of a bending angle are given. A bending dimension can be determined by calculating an elongation amount from the bending conditions and the target value of a bending angle, obtaining the absolute dimension B1 by the subtraction of the elongation amount from the target value of a bending dimension, and then, as shown in FIG. 10, setting a distance S, measured between a blade tip 3*a* of the upper die 3 and the butting members 9 and 10 of the back gauge mechanism 2, equal to the absolute dimension B1. Further, a bending angle can be determined, as shown in FIG. 11, by a push-in amount of the work W into a groove 4*a* of the lower die 4. The push-in amount is in other words a movement distance d (hereinafter referred to as an "operation amount") measured between a contact position Y1 where the upper die 3 contacts with the work W and an endmost position Y2 of the downward movement of the upper die 3. This operation amount is computed in advance from the given bending conditions and the target value of a bending angle.

Whether or not a target bending dimension and a target bending angle are achievable when bending the work W of a plate shape with the press brake having the arrangement described above is confirmed by trial bending of the work W.

First, an elongation amount in bending is computed, and then the butting members 9 and 10 of the back gauge mechanism 2 are positioned based on the computed value and the target value of a bending dimension. Next, the operation amount d of the upper die 3 is computed, and the work W positioned by the back gauge mechanism 2 is bent when the upper die 3 is moved according to the computed value of the operation amount d.

After the trial bending described above, the work W is taken out, and a bending angle is measured with a device such as a protractor. When the measured value of the bending angle agrees with a target value, the bending dimension is also measured with a device such as a vernier caliper. If the measured value of the bending angle does not agree with the target value, the bending dimension is not measured. This is because an elongation amount is dependent on a bending angle, and therefore, as long as a measured value of a bending angle does not agree with a target value of the bending angle, there is no way to know the difference between a target value of a bending dimension and a measured value of the bending dimension through the measurement of a bending dimension.

When the measured value of a bending angle does not agree with the target value, an operation amount of the upper die 3 is corrected according to an amount of the error. After the correction, trial bending may be again conducted to confirm that a measured value of a bending angle agrees with the target value.

When a measured value of a bending angle agrees with the target value, a bending dimension is measured with a device such as a vernier caliper. Here, positions of the butting members 9 and 10 are corrected when the measured value does not agree with the target value. After the correction, trial bending may be again conducted to confirm that the measure value of a bending dimension agrees with the target value.

Generally, a target bending angle and a target bending dimension are not obtainable when bending is made only based on an elongation amount and an operation amount obtained by computation. Therefore, according to the method of adjustment described above, the press machine main unit 1 is first adjusted to obtain a target bending angle, and then the back gauge mechanism 2 is adjusted to obtain a target bending dimension. This requires at least one time of trial bending for adjustment to obtain a target bending angle, and also requires at least one time of trial bending for adjustment to obtain a target bending dimension. Thus, at least two times in total of trial bending must be conducted in this case.

SUMMARY OF THE INVENTION

The invention was made to solve such problems described above, and it is an object of the invention to provide a bending method and bending apparatus with which a target bending angle and bending dimension are obtainable by performing trial bending only one time.

In accordance with one embodiment, the invention provides a method for bending work having a plate shape by moving a die toward the work, the work butted against a butting member. The method comprises computing an initial operation amount of the die from a target bending angle; positioning the butting member according to a target bending dimension; performing a trial bending step for bending a work by moving the die according to the initial operation amount with the work being butted against the positioned butting member; measuring a measured bending angle and a measured bending dimension of the work bent in the trial bending step; and determining that the measured bending angle of the work disagrees with the target bending angle. The method further includes computing a correction value for the initial operation amount of the die to provide a corrected operation amount; computing an estimated bending dimension of the work; correcting a position of the butting member according to the estimated bending dimension such that the butting member is disposed in a corrected position; and bending a second work by moving the die the corrected operation amount, the second work being butted against the butting member disposed in the corrected position.

In accordance with a further embodiment, the invention provides a bending apparatus for bending work comprising a butting portion having a butting member against which a work of a plate shape is butted; a die for bending the work butted against the back gauge mechanism; a reciprocating mechanism for reciprocating the die in a direction toward a plate face of the work; a data input portion for inputting data regarding bending conditions including a target bending angle and a target bending dimension of the work to be processed, and for inputting a measured bending angle and a measured bending dimension of the work obtained by trial bending of the work; and a first computation portion for conducting an initial computation to compute an initial operation amount of the die based on the target bending angle. The bending apparatus further includes a second computation portion for conducting a correction computation and an estimate computation when the respective measured bending angle and the measured bending dimension are inputted through the data input means; the correction computation generating a correction value for the initial operation amount of the die to provide a corrected operation amount; and the estimate computation being for computing an estimated bending dimension of the work. Additionally, the apparatus includes a control portion controlling a drive of the reciprocating mechanism based on the initial operation amount of the die and, after trial bending, the corrected operation amount, the control portion further controlling a drive of the butting portion according to the target bending dimension and, after trial bending, the estimated bending dimension.

DETAILED DESCRIPTION OF THE PREFERRED EMBODIMENTS

Figure 1:
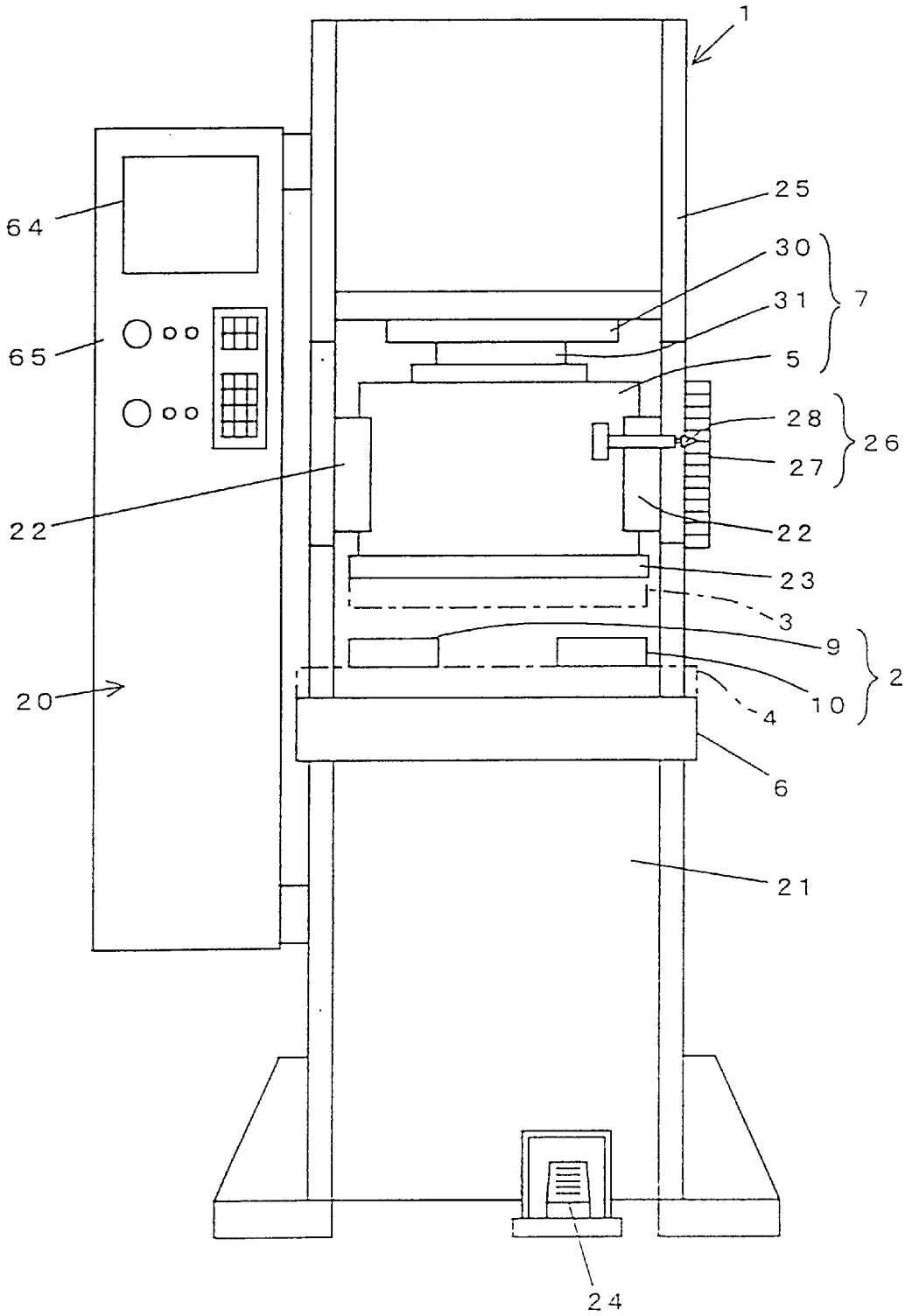
FIG. 1 is a front view showing a press brake according to an embodiment of the invention.

In accordance with one embodiment of the invention, the bending method includes an initial computation step for computing an operation amount of a die from a target value of a bending angle; a positioning step for positioning a butting member according to a target value of a bending dimension; a trial bending step for bending a work by moving the die according to the operation amount obtained in the initial computation step with the work being butted against the positioned butting member; a measurement step for measuring an actual bending angle and an actual bending dimension of the work bent in the trial bending step; a second computation step comprising a correction computation step and an estimate computation step, the steps being executed in cases where the measured value of the bending angle of the work disagrees with the target value of the bending angle, the correction computation being for computing a correction value for the operation amount of the die obtained in the initial computation step based on the operation amount of the die corresponding to the measured value of the bending angle; the estimate computation step being for computing an elongation amount of the bending dimension corresponding to the target value of the bending angle and an elongation amount of the bending dimension corresponding to the measured value of the bending angle, and for computing an estimated value of the bending dimension of the work based on computation results of the elongation amounts and the measured value of the bending dimension; a position correction step for correcting a position of the butting member according to the estimated value of the bending dimension of the work computed in the estimate computation step; and a bending step for bending the work by moving the die by the operation amount corresponding to the correction value computed in the correction computation step with the work being butted against the butting member whose position has been corrected.

According to the method described above, the operation amount of the die is computed by performing the initial computation step based on the target value of the bending angle set according to the work to be processed. Next, in the positioning step, the butting member is positioned at the position corresponding to the target value of the bending dimension, and in this state where the butting member is positioned, the trial bending step is performed. As a result, the die moves according to the operation amount obtained in the initial computation step, and thus the work is bent.

Upon completion of the trial bending described above, a worker measures the bending angle and the bending dimension of the work with an appropriate measuring instrument. When the measured value of the bending angle disagrees with the target value, the correction computation step is executed to compute a correction value for correcting the operation amount of the die obtained in the initial computation step, and an estimated value of the bending dimension of the work is computed in the estimation computation step.

In the correction computation step, the correction value for the operation amount of the die can be computed in the following way, in accordance with one embodiment of the invention. That is, from the measured value of the bending angle, the operation amount of the die necessary to obtain this bending angle is computed. Then, the correction value for the operation amount of the die is computed based on a difference between the computed operation amount of the die and the operation amount of the die obtained from the target value of the bending angle in the initial computation step.

Further, in the estimation computation step, the estimated value of the bending dimension can be computed as follows. From the target value of the bending angle and the measured value of the bending angle, elongation amounts of bending dimensions when the work is bent to the respective bending angles are computed. Then a difference between these elongation amounts is added to or subtracted from the measured value of the bending dimension to compute the estimated value of the bending dimension.

In completion of the correction computation step and the estimation computation step, the position correction step is executed to correct the position of the butting member according to the estimated value of the bending dimension computed in the estimation computation step. When the work is butted against this butting member whose position has been corrected, the bending step is performed. Then, the die moves according to the operation amount corresponding to the correction value computed in the correction computation step, and, as a result, the work is bent.

The bending apparatus according to one embodiment of the invention is provided with a back gauge mechanism, i.e., a butting portion, having a butting member against which a work of a plate shape is butted; a die for bending the work butted against the back gauge mechanism; a reciprocating mechanism for reciprocating the die in a direction toward a plate face of the work; a data input portion for inputting data on bending conditions including respective target values of a bending angle and a bending dimension of the work to be processed and respective measured values of a bending angle and a bending dimension of the work obtained by trial bending of the work; a first computation portion for conducting an initial computation to compute an operation amount of the die based on the target value of the bending angle included in the inputted data when the data on the bending conditions are inputted through the data input portion; a second computation portion for executing the correction computation and the estimation computation described herein using the measured values when the respective measured values of the bending angle and the bending dimension are inputted by the data input portion; and a control portion for controlling a drive of the reciprocating mechanism based on the operation amount of the die obtained by the initial computation or the correction value for the operation amount of the die obtained by the correction computation and for controlling a drive of the back gauge mechanism according to the target value or the estimated value of the bending dimension.

In the description herein, the "die" means an "upper die" in a bending apparatus in which the upper die is lowered to bend the work, and means a "lower die" in a bending apparatus in which the lower die is raised to bend the work. The "reciprocating mechanism" may be a one-axis drive type or a two-axis drive type, and its drive power source may be a hydraulic cylinder or a servomotor.

The data input portion is typically a keyboard, or keys provided at a place such as a control panel. The "data on bending conditions" received by the data input portion includes data such as data on the work, data on the shape of the die, and respective target values of a bending angle and a bending dimension.

The first and second computation portion and the control portion can be constituted with dedicated hardware circuits. They can also be constituted with a computer implemented with programs for executing the process of each portion.

According to the bending apparatus having the arrangement described above, when a worker inputs data on bending conditions from the data input portion prior to bending, the first computation portion executes an initial computation based on the inputted data to compute an operation amount of the die. The control portion controls the drive of the back gauge mechanism to position the butting member at the position corresponding to a target value of a bending dimension. When the reciprocating mechanism is driven with the butting member being butted against the rear end edge of the work, the control portion controls the drive of the reciprocating mechanism to move the die according to the operation amount obtained by the initial computation, conducting trial bending of the work.

Upon completion of the trial bending, the work is measured by the worker, and respective measured values of a bending angle and a bending dimension of the work are input through the data input portion. Then, correction computation and the estimation computation are carried out by the second computation portion to compute a correction value for the operation amount of the die and an estimated value of a bending dimension. As soon as the computations are completed, the control portion controls the drive of the back gauge mechanism to correct the position of the butting member according to the estimated value of the bending dimension computed by the estimation computation. When the reciprocating mechanism is driven with the rear end edge of the work being butted against the butting member, the control portion controls the drive of the reciprocating mechanism to move the die according to the operation amount corrected by the correction computation. The work is bent with this operation.

As described above, according to the invention, trial bending is executed once, and through the trial bending, a correction value for an operation amount of the die and an estimated value of a bending dimension for defining a corrected position of the butting member are obtainable from measured values of a bending angle and a bending dimension obtained by the trial bending. That is, the work can be bent to a target bending angle and a target bending dimension with only one time of trial bending, efficiency of bending work can be improved, and the waste of materials can be reduced.

Hereinafter, further aspects of the invention will be described with reference to the drawings. FIG. 1 shows an external view of a press brake according to an embodiment of the invention.

The illustrated press brake is composed of a press machine main unit 1 provided at one of its side faces with an electrical control box 20, and a back gauge mechanism 2 arranged behind this press machine main unit 1. The back gauge mechanism 2 has a pair of butting members 9 and 10 moveable to each direction of forward and backward, right and left, and upward and downward.

The press machine main unit 1 is provided with a table 6 for supporting a lower die 4 on a bed 21, and a ram 5 is arranged above the table 6 in such a manner that the ram 5 can be moved upward and downward along guides 22, 22. An upper die 3 is mounted at the lower end of the ram 5 through a holder 23. The lower die 4 has a groove of a V shape at its upper face. Pressing force of the upper die 3 is applied to a work to press it into the groove of the lower die 4, and thus the work is bent to a desired angle.

There is a foot switch 24 provided at the lower part of the front face of the bed 21. The worker steps on the foot switch 24 for the operation of raising and lowering the ram 5.

A position detector 26 for detecting the position of the ram 5 in upward and downward movements is provided between the ram 5 and a frame 25. In this embodiment, a linear sensor is used as the position detector 26. The sensor includes a scale 27 installed on the side of the frame 25 and a moveable head 28 installed on the side of the ram 5.

The moveable head 28 vertically moves on the scale 27 together with the ram 5, outputting a pulse signal as a position detection signal. The position detection signal is received by and counted in a control device 60 (shown in FIGS. 2 and 3) within an electrical control box 20, as shown in FIG. 1. Thus, the position of the ram 5 in upward and downward movements is detected according to the counted value.

The upper die 3 is moved upward and downward together with the ram 5 through the drive of the reciprocating mechanism 7, which is driven by a hydraulic cylinder 30. The hydraulic cylinder 30 is supported with the frame 25, and the ram 5 is supported at the lower end of a piston rod 31 projecting downward.

The illustrated reciprocating mechanism 7 is driven with a single piece of the hydraulic cylinder 30. However, two or more hydraulic cylinders may be used as the power source.

Figure 2:
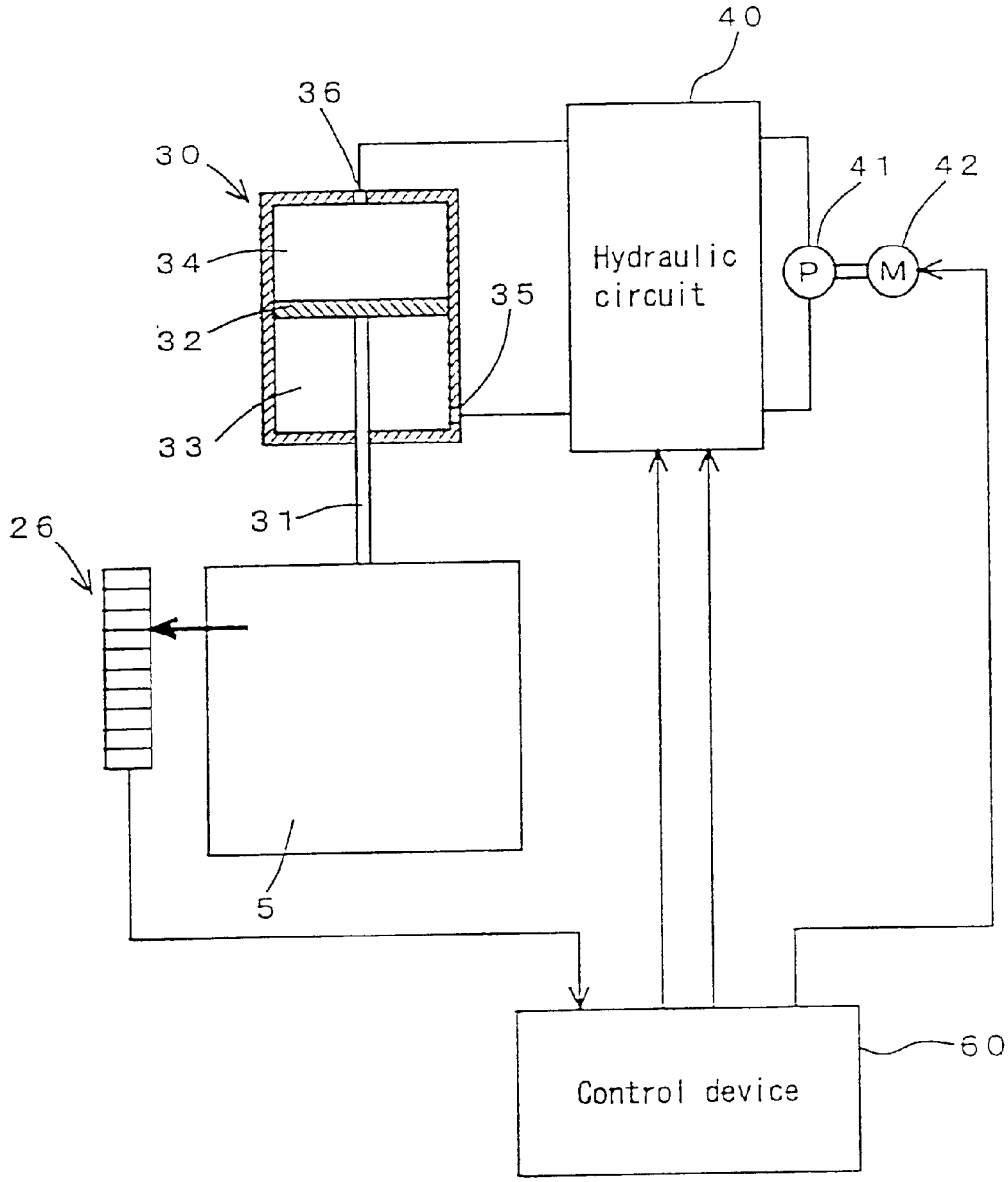
FIG. 2 is an diagram showing a reciprocating mechanism according to an embodiment of the invention.

As shown in FIG. 2, a piston 32 is arranged in a manner where it can reciprocate inside the hydraulic cylinder 30. A piston rod 31 unitized with the piston 32 projects toward the outside and supports the ram 5. A space below the piston 32 inside the cylinder 30 is defined as a first cylinder chamber 33, and that above the piston 32 is defined as a second cylinder chamber 34. Inlet/outlet ports 35 and 36 for allowing hydraulic oil to flow in and out are provided at the respective first and second cylinder chambers 33 and 34. The piston 32 of the cylinder 30 is reciprocated by introducing or discharging the hydraulic oil in and out of the respective first and second cylinder chambers 33 and 34 through the inlet/outlet ports 35 and 36.

The reciprocating mechanism 7 includes the hydraulic cylinder 30 described above, a hydraulic circuit 40 for introducing or discharging the hydraulic oil in and out of the respective hydraulic cylinder chambers 33 and 34 of the hydraulic cylinder 30, a pump 41 for feeding the hydraulic oil to the hydraulic circuit 40, and an AC servomotor 42 for driving the pump 41. The reciprocating mechanism 7 is controlled with a control device 60 shown in FIG. 3, and the piston 32 of the cylinder 30 reciprocates to raise and lower the upper die 3.

Figure 3:
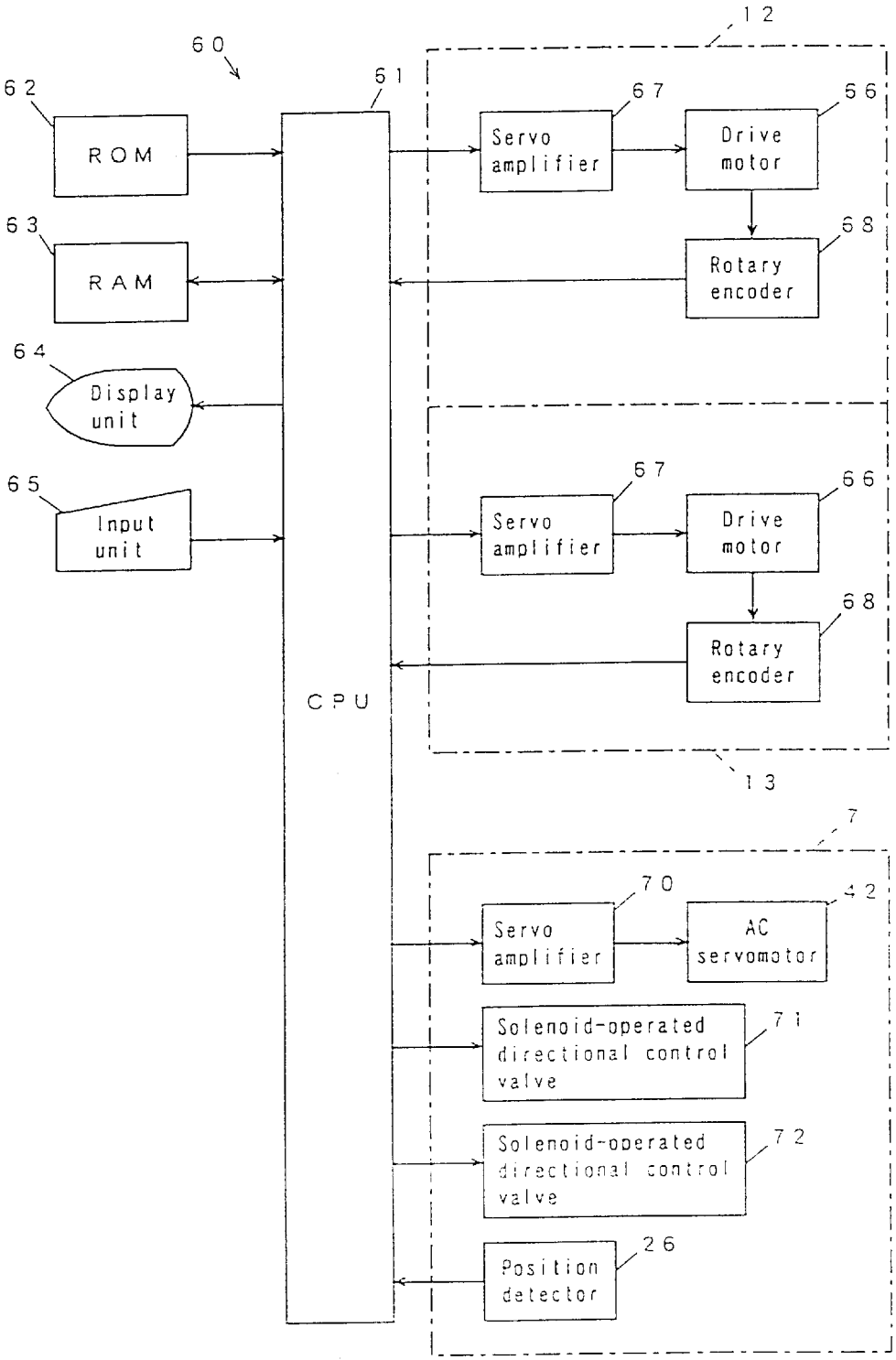
FIG. 3 is a block diagram showing an electrical arrangement of a control device according to an embodiment of the invention.

The control device 60 shown in FIG. 3, constituted with a microcomputer, is integrated in the electrical control box 20. Further, the control device 60 includes a CPU 61 that is the main part of control and computation, a ROM 62 for storing programs and fixed data, and a RAM 63 for reading and writing data such as computed results. A display unit 64 and an input unit 65 that includes different keys used for setting machine operation and data input are provided at an outer face of the electrical control box 20. The display unit 64 and the input unit 65 are connected to the CPU 61.

Also electrically connected to the CPU 61 are the drive mechanisms 12 and 13 of the back gauge mechanism 2. Each of the drive mechanisms 12 and 13 is composed of a ball screw mechanism. The CPU 61 gives a servo amplifier 67 output for drive motors 66 of the respective drive mechanisms 12 and 13, and the servo amplifier 67 amplifies the output to give it to the drive motors 66. A rotary encoder 68 is connected to each of the drive motors 66. The rotary encoders 68 detect rotational angles of the drive motors 66, or operation amounts of the drive mechanisms 12 and 13, y and they output the detected values to the CPU 61.

Also, electrically connected to the CPU 61 is the reciprocating mechanism 7 of the press machine main unit 1. The CPU 61 gives a servo amplifier 70 output for the AC servo motor 42 of the reciprocating mechanism 7, and the servo amplifier 70 amplifies the output to give it to the AC servomotor 42. Elements with numerals 71 and 72 in FIG. 3 are solenoid-operated directional control valves, arranged at appropriate positions in the hydraulic circuit 40, for switching passages for the hydraulic oil in the hydraulic circuit 40. The CPU 61 outputs a drive signal for controlling the drive of the magnetic solenoids of the respective valves 71,72.

Figure 4:
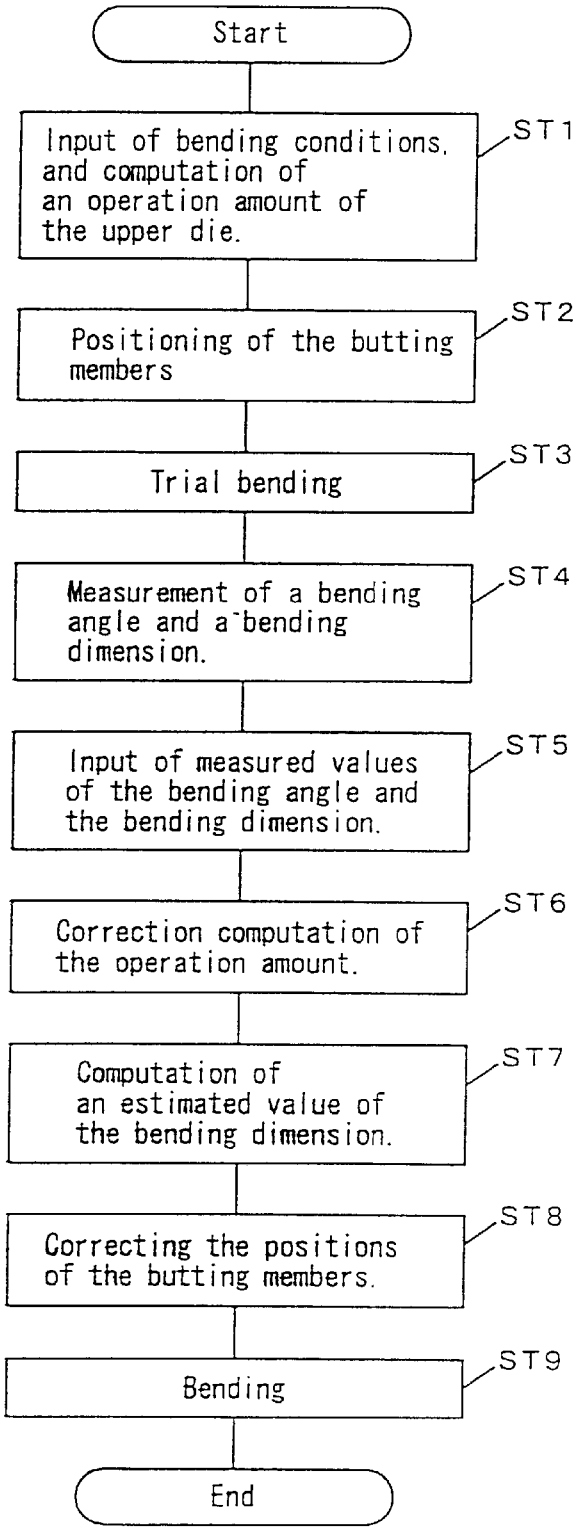
FIG. 4 is a flowchart describing the procedure of a bending method according to an embodiment of the invention.
Figure 5:
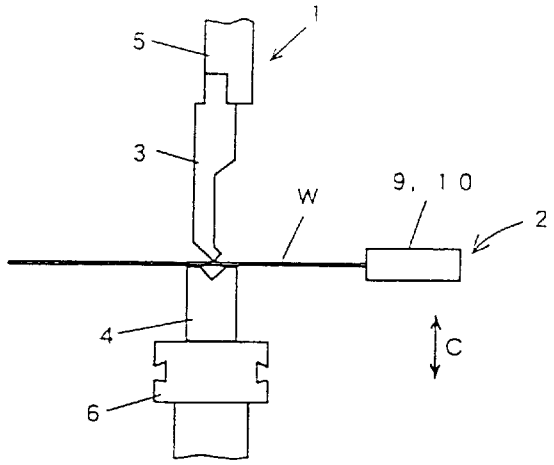
FIG. 5 is a side view schematically showing a press brake.
Figure 6:
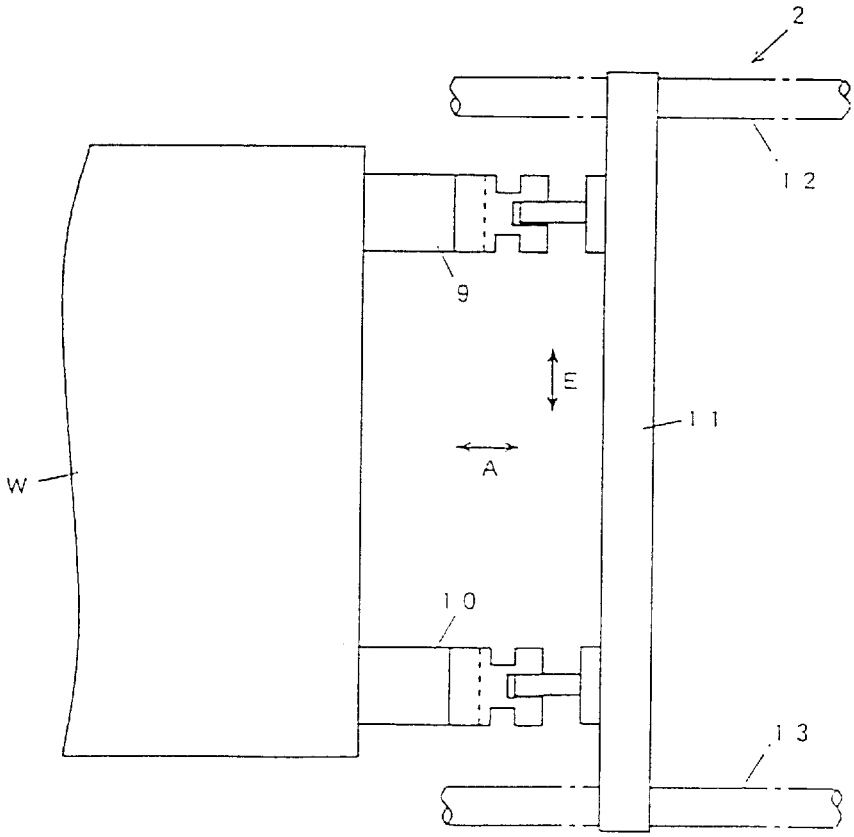
FIG. 6 is a plan view schematically showing a back gauge mechanism.
Figure 7:
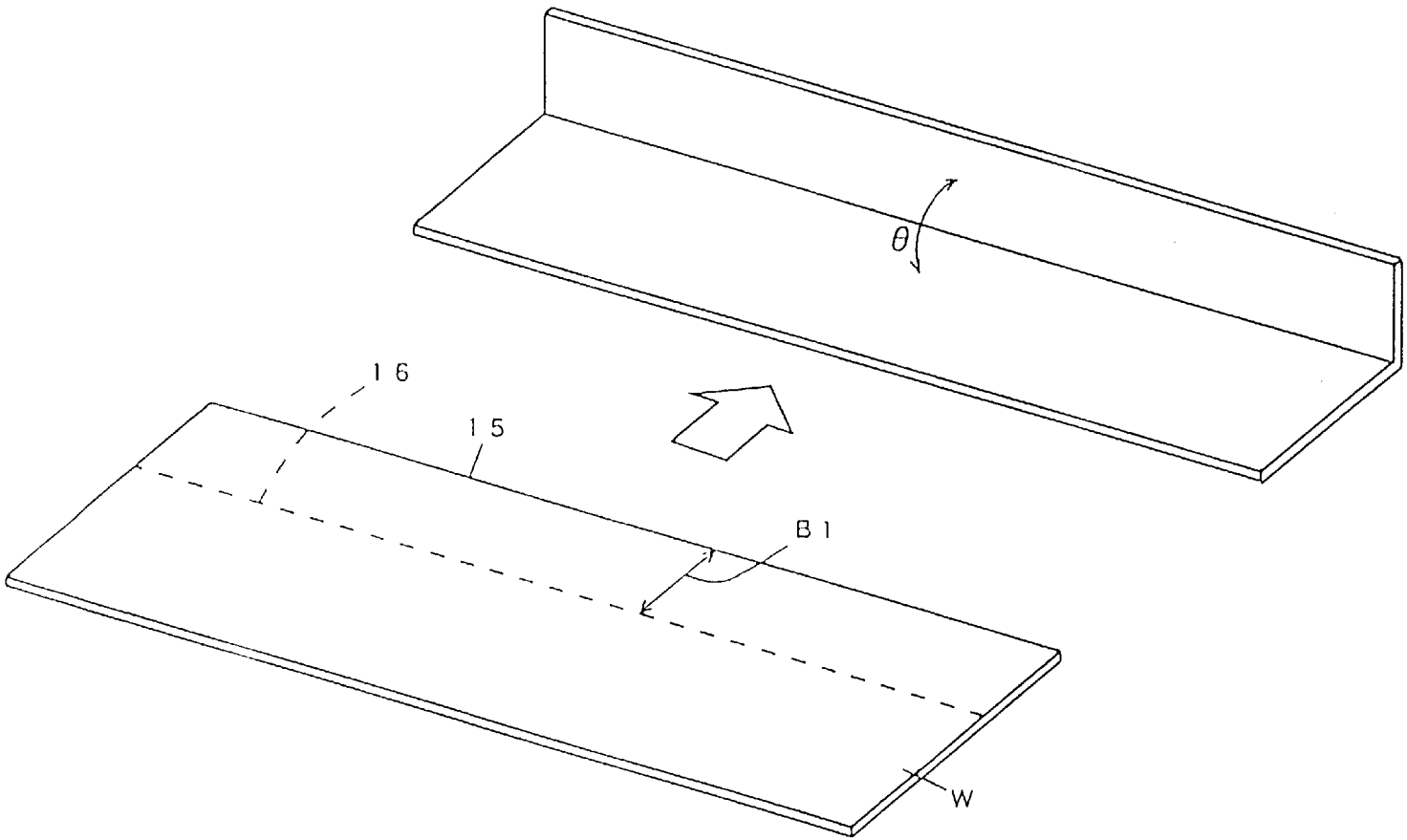
FIG. 7 is a perspective view of a work of a plate shape, showing a state where a work is bent.
Figure 8:
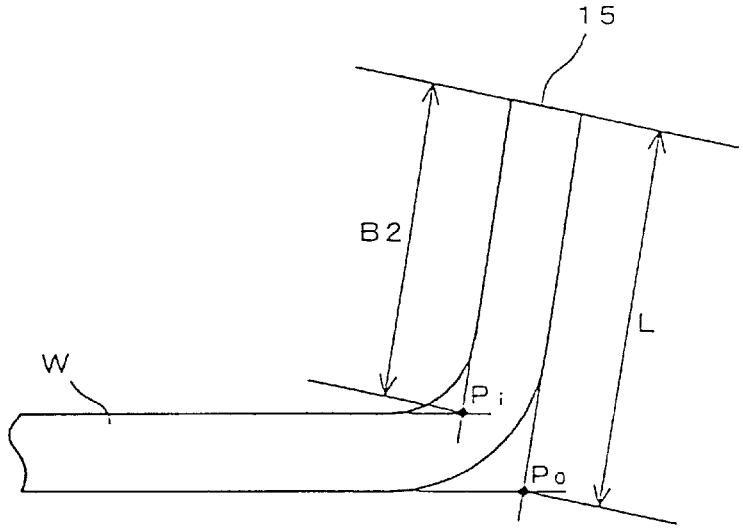
FIG. 8 is a side view of a work showing a bent state.
Figure 9:
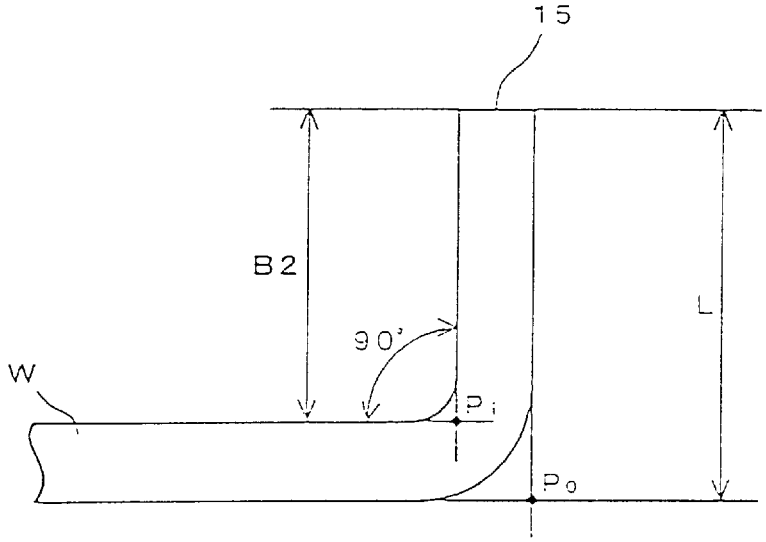
FIG. 9 is a side view of a work showing a bent state with a bending angle of 90 degrees.
Figure 10:
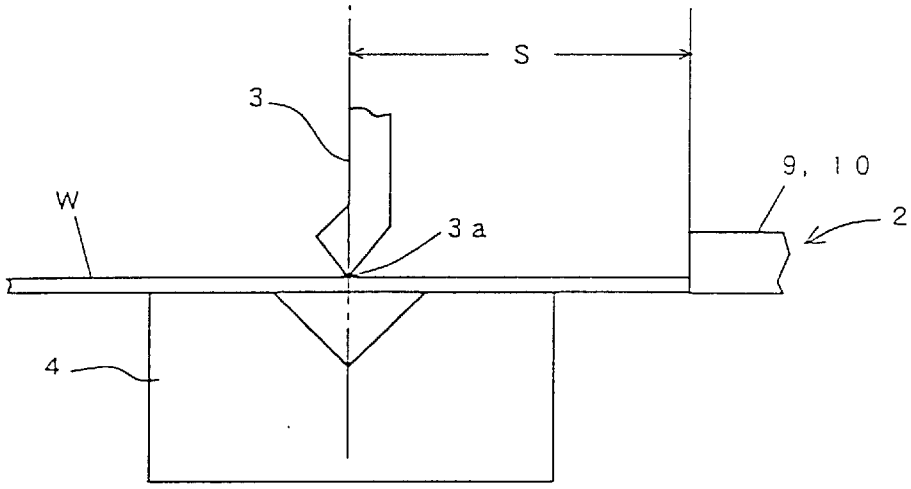
FIG. 10 is a side view of upper and lower dies, illustrating a method of setting a bending dimension.
Figure 11:
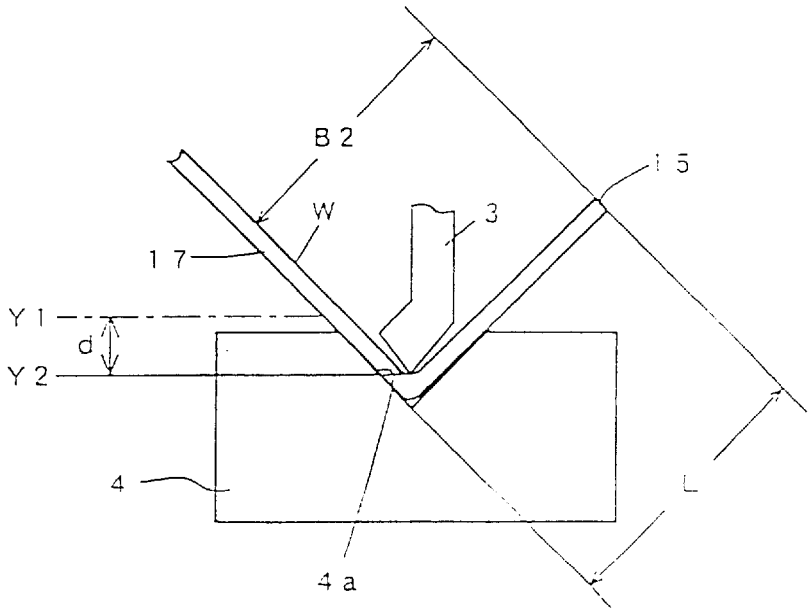
FIG. 11 is a side view of upper and lower dies, showing the concept of a bending angle and a bending dimension.

FIG. 4 describes the procedure of a bending method using the press brake having the arrangement described above. "ST" in the figure is an abbreviation of "STEP."

Prior to the start of the process of FIG. 4, a target value θ of a bending angle and a target value L of a bending dimension of the work are determined. Suppose that the target angle θ of the bending angle is 90 degrees, and the target value L of the bending dimension is 50 mm.

First, in ST1 of FIG. 4, the worker inputs data on bending conditions including the target values θ and L of the bending angle and the bending dimension, respectively, through the input unit 65. Then, the CPU 61 of the control device 60 intakes the inputted data, and executes the initial computation of the following expression (1) to compute an operation amount d of the upper die 3 (for obtaining the target value θ of the bending angle), that is, a push-in amount of the work into the groove 4*a* of the lower die 4. Here, let the operation amount d of the upper die 3 be 5 mm as a specific example.

$$d=f(\theta, M_1, \ldots, M_n, D_1, \ldots, D_n) \quad \text{Expression (1)}$$

In the expression above, $M_1$ to $M_n$ are data on the work such as a tensile strength, plate thickness, and plate dimension, and $D_1$ to $D_n$ are data on the shapes of the dies, such as a tip radius of the upper die 3, and a groove width and a groove shoulder radius of the lower die 4. Thus, the operation amount d of the upper die 3 is a function of the data of $M_1$ to $M_n$ and $D_1$ to $D_n$, and the target value θ of a bending angle.

In the next step, ST2, the control device 60 controls the drive of the drive mechanisms 12 and 13 of the back gauge mechanism 2 to position the butting members 9 and 10 at the positions corresponding to a value obtained by the subtraction of an elongation amount, which is caused by bending and obtainable by computation, from the target value L of a bending dimension.

In the next step, ST3, the worker inserts the work W between the upper die 3 and lower die 4 of the press machine main unit 1, and butts the rear end edge of the work against the butting members 9 and 10. With the work being butted against the butting members 9 and 10, the worker steps on the foot switch 24 for the operation to drive the reciprocating mechanism 7. The control device 60 controls the drive of the reciprocating mechanism 7 to lower the upper die 3. When the upper die 3 contacts with the work W, the control device 60 lowers the upper die 3 from the contact position by the operation amount d obtained by the initial computation. With this operation, the work W is pushed into the groove of the lower die 4 and bent.

After finishing the trial bending described above, in the next step, ST4, the worker takes the work W out of the press machine main unit 1 to measure a bending angle and a bending dimension with an appropriate instrument. In the specific example, assume that a measured value θ' of the bending angle is 92 degrees, and a measured value of the bending dimension L' is 50.1 mm.

In the next step, ST5, the worker inputs the respective measured values θ' and L' of the bending angle and the bending dimension through the input unit 65. Then the CPU 61 of the control device 60 computes a correction value for the operation amount d in ST6. In this ST6, an operation amount d' of the upper die 3 (corresponding to the measured value θ' defined as the target value of a bending angle) is first obtained by the computation of Expression (1). After that the difference Δd between the operation amount d of the upper die 3 obtained by the initial computation and the operation amount d' of the upper die 3 is computed. In the specific example, if the operation amount d' of the upper die 3 were 4.8 mm, the difference Δd would be Δd=d−d'=5 (mm)−4.8 (mm)=0.2 (mm).

Next, the CPU 61 adds the difference Ad to the operation amount d of the upper die 3 to correct the operation amount d of the upper die 3. In the specific example, because the operation amount d is 5 mm and the difference Δd is 0.2 mm, the operation amount d of the upper die 3 after the correction is 5 (mm)+0.2 (mm)=5.2 (mm), i.e., a corrected operation amount "d".

In the next step, ST7, the CPU 61 computes an estimated value of the bending dimension. More specifically, in this ST7, computations of the following Expressions (2) and (3) are first executed to compute (i) an elongation amount h of the bending dimension corresponding to the target value θ; as well as (ii) an elongation amount h' of the bending dimension corresponding to the measured value θ' of the bending angle.

$$h = (Ri + t)\tan\{(180 - \theta)/2\} - \pi(Ri + \lambda t)\{(180 - \theta)/360\} \quad \text{Expression (2)}$$

$$h' = (Ri + t)\tan\{(180 - \theta')/2\} - \pi(Ri + \lambda t)\{(180 - \theta')/360\} \quad \text{Expression (3)}$$

In the expressions above, t is the thickness of the work. Further, Ri is an inside bending radius at the bend portion of the work, and is given as a function of a groove width ω of the lower die 4, the thickness t of the work, and a tensile strength σ of the work. Further, λ is a coefficient obtainable by Expression (4) below.

$$\lambda = 0.42 + 0.035(Ri/t - 1) \quad \text{Expression (4)}$$

Next, the CPU 61 computes a difference Δh between the elongation amount h of the bending dimension corresponding to the target value θ of the bending angle and the elongation amount h' of the bending dimension corresponding to the measured value θ' of the bending angle. If the elongation amount h were 2 mm, and the elongation amount h' were 1.9 mm, the difference Δh would be h−h'=2 (mm)−1.9 (mm)=0.1 mm.

Next, the CPU 61 adds the difference Δh to the measured value L' of the bending dimension to compute an estimated value L1 of the bending dimension. If the measured value L' of the bending dimension were 50.1 mm (because the target value L of the bending dimension is 50 mm), then the estimated value L1 of the bending dimension would be L1=L'+Δh=50.1 (mm)+0.1 (mm)=50.2 (mm) in the specific example.

In the next step, ST 8, the control device 60 controls the drive of the drive mechanisms 12 and 13 of the back gauge mechanism 2 to correct the positions of the butting members 9 and 10 according to the computed estimated value L1 of the bending dimension.

In the next step, ST9, the worker inserts the work between the upper die 3 and lower die 4 of the press machine main unit 1, butts the rear end edge of the work against the butting members 9 and 10, and, in this state, steps on the foot switch 24 for operating it to drive the reciprocating mechanism 7. The control device 60 controls the drive of the reciprocating mechanism 7 to lower the upper die 3. When the upper die 3 contacts with the work, the control device 60 lowers the upper die 3 from the contact position by the operation amount d obtained by the correction computation. With this operation, the work W is pushed into the groove of the lower die 4 and bent.

In the example described above, correction of an operation amount of the upper die 3 and computation of an estimated value of the bending dimension are performed according to results of the measurement of the bending angle and bending dimension at one position of the work bent in the trial bending step (at the center of the work, for example). However, in a two-axis drive model using two hydraulic cylinders as a drive source for the reciprocating mechanism 7, it may be that the bending angle and the bending dimension of the work are measured, respectively, at both end portions of the work in a trial bending step, and an operation amount of the upper die 3 and an estimated value of the bending dimension are obtained, respectively, for each axis.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A method for bending work having a plate shape by moving a die toward the work, the work butted against a butting member, the method comprising:

computing an initial operation amount of the die from a target bending angle;

positioning the butting member according to a target bending dimension;

performing a trial bending step for bending a work by moving the die according to the initial operation amount with the work being butted against the positioned butting member;

measuring a measured bending angle and a measured bending dimension of the work bent in the trial bending step;

determining that the measured bending angle of the work disagrees with the target bending angle;

computing a correction value for the initial operation amount of the die to provide a corrected operation amount;

computing an estimated bending dimension of the work;

correcting a position of the butting member according to the estimated bending dimension such that the butting member is disposed in a corrected position; and bending a second work by moving the die the corrected operation amount, the second work being butted against the butting member disposed in the corrected position.

2. The method of claim 1, wherein computing the correction value for the initial operation amount of the die to provide a corrected operation amount includes the correction value being based on a calculated operation amount of the die corresponding to the measured bending angle.

3. The method of claim 2, wherein computing the correction value for the initial operation amount of the die to provide a corrected operation amount includes:

determining an interim operation amount based on the measured bending angle;

determining a difference between the initial operation amount and the interim operation amount; and adding the difference to the initial operation amount to obtain the corrected operation amount.

4. The method of claim 1, wherein computing an estimated bending dimension of the work includes:

determining a first elongation amount that corresponds to the target bending angle;

determining a second elongation amount that corresponds to the measured bending angle; and determining the estimated bending dimension based the first elongation amount, the second elongation amount and the measured bending dimension.

5. The method of claim 4, wherein computing an estimated bending dimension of the work further includes;

determining a difference between the first elongation amount and the second elongation amount;

adding the difference to the measured bending dimension to result in the estimated bending dimension.

6. The method of claim 4, wherein computing the correction value for the initial operation amount of the die to provide a corrected operation amount includes the correction value being based on a calculated operation amount of the die corresponding to the measured bending angle.

7. The method of claim 1, wherein a computer is used in performing at least one of the computing steps.

8. A bending apparatus for bending work comprising:

a butting portion having a butting member against which a work of a plate shape is butted;

a die for bending the work butted against the butting member;

a reciprocating mechanism for reciprocating the die in a direction toward a plate face of the work;

a data input portion for inputting data regarding bending conditions including a target bending angle and a target bending dimension of the work to be processed, and for inputting a measured bending angle and a measured bending dimension of the work obtained by trial bending of the work;

a first computation portion for conducting an initial computation to compute an initial operation amount of the die based on the target bending angle;

a second computation portion for conducting a correction computation and an estimate computation when the respective measured bending angle and the measured bending dimension are inputted through the data input means;

the correction computation generating a correction value for the initial operation amount of the die to provide a corrected operation amount; and the estimate computation being for computing an estimated bending dimension of the work; and a control portion controlling a drive of the reciprocating mechanism based on the initial operation amount of the die and, after trial bending, the corrected operation amount, the control portion further controlling a drive of the butting portion according to the target bending dimension and, after trial bending, the estimated bending dimension.

9. The bending apparatus of claim 8, wherein the butting portion is a back gauge mechanism.

10. The bending apparatus of claim 8, wherein the correction computation includes computing a correction value for the initial operation amount of the die, the correction value based on an interim operation amount of the die that corresponds to the measured bending angle.

11. The bending apparatus of claim 10, wherein the correction computation includes:

determining an interim operation amount based on the measured bending angle;

determining the correction value, the correction value being a difference between the initial operation amount and the interim operation amount; and adding the difference to the initial operation amount to obtain the corrected operation amount.

12. The bending apparatus of claim 8, wherein the estimate computation includes:

computing a first elongation amount of the bending dimension corresponding to the target bending angle;

computing a second elongation amount corresponding to the measured bending angle; and computing an estimated bending dimension of the work based on first elongation amount, the second elongation amount and the measured bending dimension.

13. The bending apparatus of claim 12, wherein the estimation computation further includes;

determining a difference between the first elongation amount and the second elongation amount; and adding the difference to the measured bending dimension to result in the estimated bending dimension.

14. The bending apparatus of claim 13, wherein the correction computation includes computing a correction value for the initial operation amount of the die, the correction value based on an interim operation amount of the die that corresponds to the measured bending angle.

15. The bending apparatus of claim 8, wherein at least one of the first computation portion and the second computation portion is in the form of a computer.

16. A bending apparatus for bending work comprising:

a butting portion having a butting member against which a work of a plate shape is butted;

a die for bending the work butted against the butting member;

a reciprocating mechanism for reciprocating the die in a direction toward a plate face of the work;

means for inputting data regarding bending conditions including a target bending angle and a target bending dimension of the work to be processed, and for inputting a measured bending angle and a measured bending dimension of the work obtained by trial bending of the work;

means for conducting an initial computation to compute an initial operation amount of the die based on the target bending angle;

means for conducting a correction computation and an estimate computation when the respective measured bending angle and the measured bending dimension are inputted through the data input means;

the correction computation generating a correction value for the initial operation amount of the die to provide a corrected operation amount; and the estimate computation being for computing an estimated bending dimension of the work; and means for controlling a drive of the reciprocating mechanism based on the initial operation amount of the die and, after trial bending, the corrected operation amount, the means for controlling further controlling a drive of the butting portion according to the target bending dimension and, after trial bending, the estimated bending dimension.

17. A method for bending work having a plate shape by moving a die toward the work, the work butted against a butting member, the method comprising:

computing an initial operation amount of the die from a target bending angle;

positioning the butting member according to a target bending dimension;

performing a trial bending step for bending a work by moving the die according to the initial operation amount with the work being butted against the positioned butting member;

measuring a measured bending angle and a measured bending dimension of the work bent in the trial bending step;

determining that the measured bending angle of the work disagrees with the target bending angle;

computing a correction value for the initial operation amount of the die to provide a corrected operation amount;

computing an estimated bending dimension of the work;

correcting a position of the butting member according to the estimated bending dimension such that the butting member is disposed in a corrected position; and bending a second work by moving the die the corrected operation amount, the second work being butted against the butting member disposed in the corrected position; and wherein computing the correction value for the initial operation amount of the die to provide a corrected operation amount includes:

determining an interim operation amount based on the measured bending angle;

determining a difference between the initial operation amount and the interim operation amount; and adding the difference to the initial operation amount to obtain the corrected operation amount; and wherein computing an estimated bending dimension of the work includes:

determining a first elongation amount that corresponds to the target bending angle;

determining a second elongation amount that corresponds to the measured bending angle; and determining the estimated bending dimension based the first elongation amount, the second elongation amount and the measured bending dimension.

* * * * *